United States Patent [19]

Ménard et al.

[11] 4,166,646

[45] Sep. 4, 1979

[54] LATCHING PLATE ESPECIALLY FOR AUTOMOBILE DOORS

[75] Inventors: Michel Ménard, Beynes; Robert Cherbourg, Bueil; Jean P. Falluel, Pierrelaye, all of France

[73] Assignee: Regie Nationale des Usines Renault, Boulogne-Billancourt, France

[21] Appl. No.: 807,641

[22] Filed: Jun. 17, 1977

[30] Foreign Application Priority Data

Jun. 18, 1976 [FR] France ..... 76 18609

[51] Int. Cl.[2] ..... E05C 13/00

[52] U.S. Cl. ..... 292/336.3

[58] Field of Search ..... 292/216, 280, DIG. 23, 292/DIG. 25, 336.3

[56] References Cited

U.S. PATENT DOCUMENTS

| | | | |
|---|---|---|---|
| 2,993,360 | 7/1961 | Craig | 292/DIG. 26 |
| 3,190,682 | 6/1965 | Fox et al. | 292/216 |
| 3,232,656 | 2/1966 | Coverly et al. | 292/DIG. 24 |

*Primary Examiner*—Richard E. Moore

*Attorney, Agent, or Firm*—Oblon, Fisher, Spivak, McClelland & Maier

[57] ABSTRACT

A latching plate, especially for automobile doors, characterized by a multifunction principal lever which can pivot, about an axis fixed to a support, either in a first direction in order to lock the latch, whether under the action of an external locking bolt or under the action of an internal control lever, or in a second direction, opposite to the first, in order to unlock the latch and open the door under the reverse action of the internal control lever or the bolt, or even in order to unlock the latch automatically by slamming the door on closing it.

10 Claims, 7 Drawing Figures

LATCHING PLATE ESPECIALLY FOR AUTOMOBILE DOORS

BACKGROUND OF THE INVENTION

1. Field of the Invention

The present invention relates to automobile door locks, and in particular to a simplified internal latch intended for installation in doors of the said vehicles.

2. Description of the Prior Art

Known latches generally comprise a support plate on which are mounted several levers which perform more or less complicated movements under the action of other internal and external control levers independent of the plate. In this type of latch, the various levers attached to the support plate separately provide certain of the following functions, but not all of them.

1. opening of the door from the outside,
2. opening of the door from the inside,
3. locking and unlocking of the latch from outside,
4. locking and unlocking of the latch from inside and,
5. automatic unlocking of the latch when the door is slammed shut.

SUMMARY OF THE INVENTION

The object of the invention is to provide a latch plate providing all of the functions enumerated above by means of a single main lever, which represents a great simplification and savings in fabricating such latches.

To this end, the present invention attained the foregoing object through the provision of a latch plate, especially for automobile doors, characterized by a multifunction main lever which can pivot, about an axis fastened to a support, either in a first direction in order to lock the latch, whether under the action of an external locking bolt or under the action of an internal control lever, or in a second direction, opposite to the first, in order to unlock the latch and then open the door under the reverse action of the internal control lever or the bolt, or even in order to permit unlocking the latch automatically when the door is slammed shut.

The unique main lever of the present invention gets rid at one and the same time of the motions and consequent friction of the levers which it replaces, thus improving the operation of the latch.

BRIEF DESCRIPTION OF THE DRAWINGS

Various other objects, features and attendant advantages of the present invention will be more fully appreciated as the same becomes better understood from the following detailed description when considered in connection with the accompanying drawings, in which like reference numerals designate like or corresponding parts throughout the several figures, and wherein.

DETAILED DESCRIPTION OF THE PREFERRED EMBODIMENTS

Figure 1:
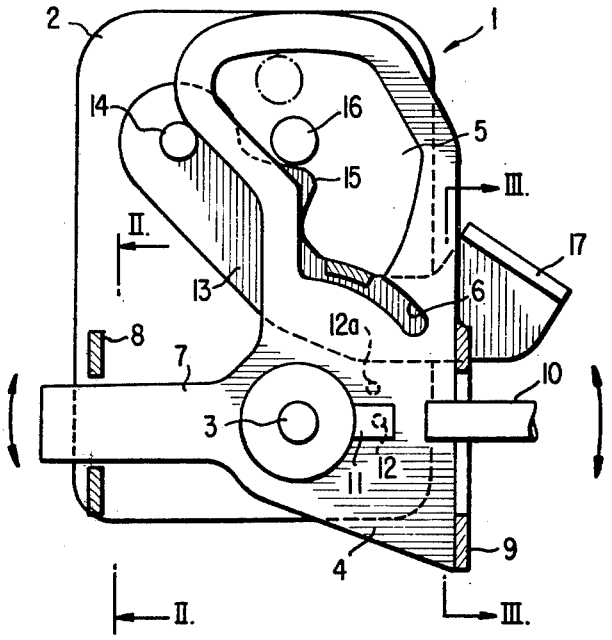
FIG. 1 is an elevation view of the latch showing the principal lever of the present invention in the neutral position.

Referring to FIG. 1, the latch plate 1 consists of a support 2 on which is mounted, so as to pivot about an axis 3, a principal lever 4 of irregular shape, comprising essentially an opening 5 prolonged at its lower part by a locking slot 6, a horizontal extension 7 actuated by an internal control lever 8, and a vertical tab 9 disposed at right angles relative, opposite the extension thereto and, notched to permit passage of a finger 10 of an external locking bolt. By rotation in a first direction about its axis 3, the principal lever 4 can be held in the neutral position, shown in FIG. 1, or in the locked position, shown in FIG. 6, by means of a conventional arrangement holding the principal lever 4 in two stable positions. Here it is from being a leaf spring 11 pressing against the support 2, a ball 12 of smaller diameter than a hole in the principal lever 4 serving as its seat, but being of larger diameter than two holes in the support situated on the circular arc 12*a* about the axis 3 of the main lever, the holes corresponding to the two stable positions.

The latch plate 1 also supports an external control lever 13 which pivots about a second axis 14, the lever having a cam projection 15 for actuating a cam finger 16 integral with the lock bolt (not shown), driving it across the opening 5 in the main lever. The other end of the external control lever 13 is bent to form a right-angle tab 17 to which is attached an operating button, not shown. This direct external control can be the same as that constituting the object of a previous application, French Pat. No. 2,355,150 by the present applicant.

This arrangement has the particular advantage of being completely recessed in the door frame with nothing projecting from the outer surface of the door, so as to improve safety in case the vehicle rolls over.

Figure 2:
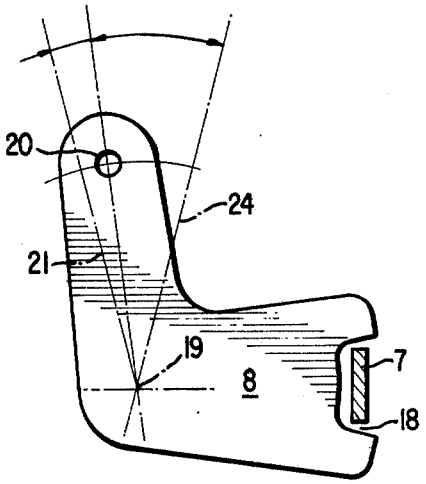
FIG. 2 shows different positions of the internal control lever of the present invention seen along the line II of FIG. 1.

As is shown in FIG. 2, the extension 7 of the principal lever 4 engages a notch 18 in the internal control lever 8 which is situated at right angles to the extension to permit actuation of the main lever in one direction or the other. To this end, the internal control lever 8 can pivot about its axis 19, under the action of a control rod, not shown, which hooks into a hole 20 in the vertical arm of the lever. As will be seen later in the description of the invention, this internal control serves both for opening the door and for the locking/and unlocking of the latch from inside the vehicle.

Figure 3:
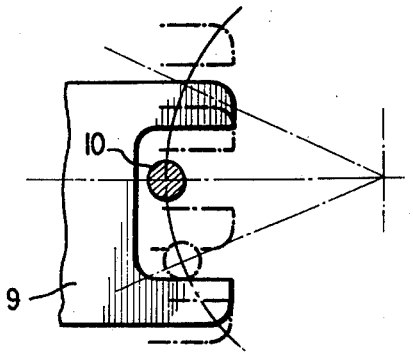
FIG. 3 shows different positions of the finger of the external locking bolt taken along the line III of FIG. 1.

In FIG. 3, it is seen that the vertical tab 9 of the principal lever 4 can occupy different positions, shown by dashed lines such, positions corresponding to the pivoting of the principal lever in one direction or the other, under the action of finger 10 of the external control bolt. This bolt, of conventional design, is mounted on the door and is in the form of a cylinder operated by a key, the finger of the bolt returning to its neutral position under the action of a return spring incorporated in the cylinder. Thus, downward rotation of the finger 10 in FIG. 3 corresponds to opening the door, while upward rotation corresponds to locking the latch.

A description of the operation of the latch follows, reference being made to FIGS. 4 to 7.

Figure 4:
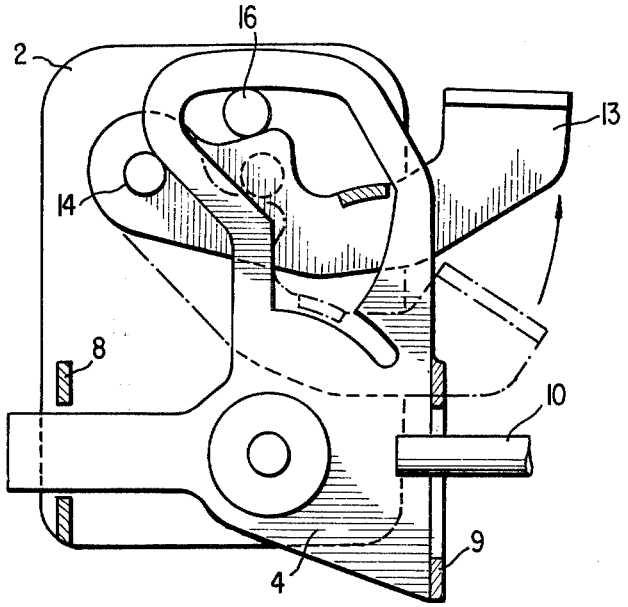
FIG. 4 illustrates the opening of the door by the external control lever, the principal lever remaining in the neutral position.

In FIG. 4, the external control lever 13 has been brought from its lower position of rest, shown in dashed lines, to its upper position, causing the finger of cam 16 to pivot about the common axis 14. This position corresponds to the opening of the door by the external control lever 13, the lock bolt being thus freed from the catch. The external control lever then returns automatically to its position of rest, when it is released, thanks to the action of a return spring, not shown, for example, a torsion spring coiled around the axis 14 of the lever. It will be noted that the principal lever 4 remains in the neutral position that it occupies in FIG. 1 and that it serves here only as the upper stop for the cam finger 16.

Figure 5:
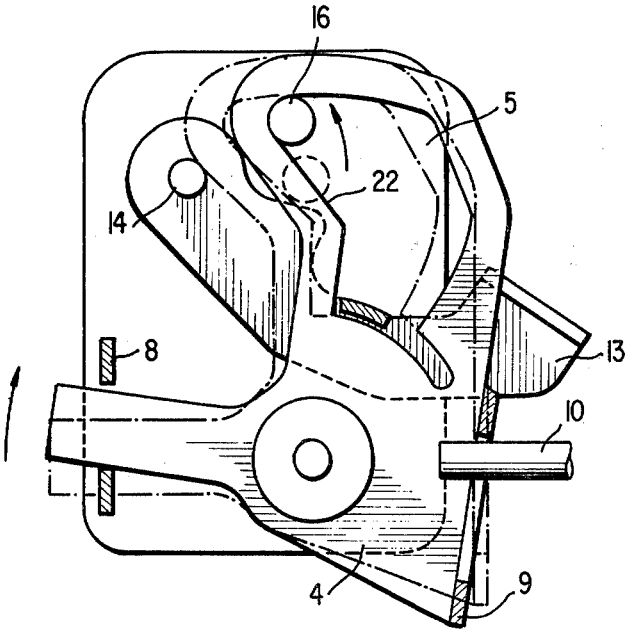
FIG. 5 illustrates the opening of the door by the internal control lever, the principal lever being rotated in the second direction.

In FIG. 5 the principal lever 4 is pivoted from its neutral position in the clockwise direction, called the second direction, under the action of the internal control lever 8, the axis of the vertical arm of which is then in the position 21 shown in FIG. 2. In the course of rotating the main lever 4, the cam finger 16 encounters a first straight inclined portion 22 of the opening 5 in the main lever, which forces the finger 16 upwards in the figure, in the direction for opening the door. For this reason, this straight portion 22 is called the opening ramp. At the end of the motion, the cam finger 16 is situated in the upper lefthand corner of the opening 5 of the main lever, which can then pivot no further. This position is unstable, the principal lever tending then to return to its neutral position under the action of the spring 11, and ball 12.

Figure 6:
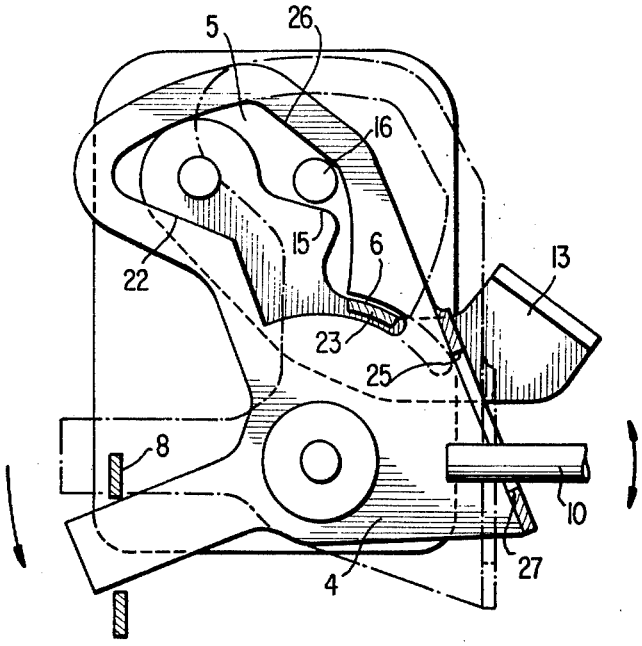
FIG. 6 shows the latch locked, the principal lever being rotated in the first direction.

In FIG. 6 the latch is shown locked, i.e., the locking slot 6 of the main lever 4 catches a lug 23 on the external control lever 13 which is held in its position of rest. To arrive at this stable position, the principal lever 4 has to pivot in a first direction from its neutral position, either by operation of the internal control lever 8, being moved to the position 24 in FIG. 2, the reverse of the above, or by the movement of the finger 10 of the bolt pressing against the upper edge 25 of the right-angle tab 9 of the main lever. By the rotation of the main lever 4, the cam finger 16 is caught between the cam projection 15 of the external control lever 13 and a second straight inclined portion 26 of the opening 5 in the principal lever, a portion essentially opposite the first inclined portion 22 and called the unlocking ramp for the following reason.

The latch 1 can be unlocked in three different ways with the main lever 4 pivoting in the second direction (clockwise): (1) by the movement of the internal control lever 8 in the same direction as for opening (FIG. 5), (2) by movement of the finger 10 of the bolt against the lower edge 27 of the tab of the main lever (FIG. 6) the finger 10 then returning to its stable position shown by solid lines, and finally, (3) automatically, by slamming the door shut, referring to FIG. 7.

Figure 7:
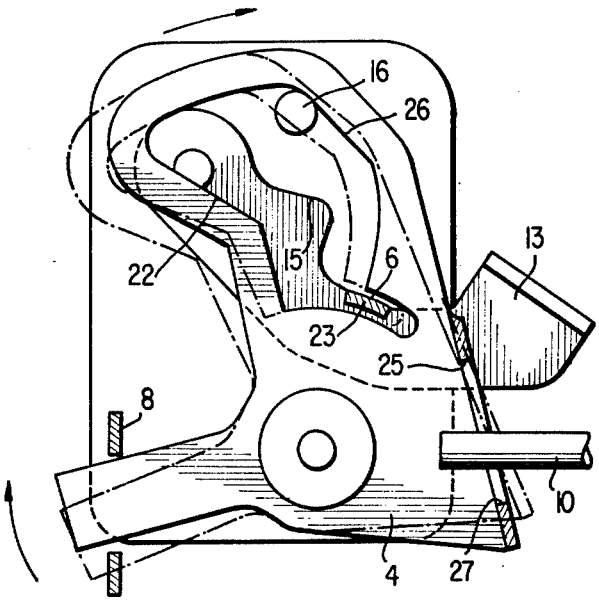
FIG. 7 shows the principal lever in an intermediate position, between its locked position and its neutral position, after the door is slammed shut, unlocking it automatically.

FIG. 7 shows the principal lever 4 in an intermediate position. The door has just been slammed shut and, the cam finger 16, driven by the lock bolt in penetrating the catch of the lock, is forced upwards as far as it will go from its position in FIG. 6. Consequently, by its action on the unlocking ramp 26 of the principal lever, the cam finger 16 starts the motion of the lever in the second direction (clockwise) corresponding to the unlocking of the latch. The completion of the rotation into the neutral position (FIG. 1) results from the action of the return spring and the inertia of the main lever.

Other modifications and variations of the present invention are obviously possible in light of the teachings herein. Thus, in particular, the design of the principal lever 4 can be modified so as to assume part or all of the different functions enumerated in the introduction of the present application, so as to answer to the standards in force, differing from country to country.

Accordingly, the present invention can be practiced, within the scope of the appended claims, otherwise than as specifically described herein.

We claim:

1. A door locking device for an automobile which comprises:
   - a support on the automobile door;
   - a locking lever pivotably mounted on said support, being movable in a first direction for locking said door and movable in a second direction, opposite the first, for unlocking and opening said door;
   - a first control lever attached to said automobile cooperable with said locking lever for moving said locking lever selectively in either said first direction or said second direction;
   - a locking bolt cooperable with said locking lever for moving said locking lever selectively in either said first direction or said second direction; and
   - means for moving said locking lever in said second direction responsive to the closing of said door wherein said locking lever can be held in a neutral or locking position by a spring with two stable positions.

2. A door locking device for an automobile which comprises:
   - a support on the automobile door;
   - a locking lever pivotably mounted on said support, being movable in a first direction for locking said door and movable in a second direction, opposite the first, for unlocking and opening said door;
   - a first control lever attached to said automobile cooperable with said locking lever for moving said locking lever selectively in either said first direction or said second direction;
   - means for moving said locking lever in said second direction responsive to the closing of said door wherein said locking lever has an opening therein, including an elongate slot portion, and further comprising a second control lever having a lug engageable with said slot portion, to thereby prevent operation of said second control lever and thus to lock said door.

3. An automobile door locking device according to claim 2, which further comprises a cam finger mounted on said support wherein said second control lever is pivotably mounted on said support in order to actuate, by means of a projection thereon, said cam finger, driving it across said opening in said locking lever, said cam finger being attached directly to a second door locking bolt, in order to open the door.

4. An automobile door locking device according to claim 3, wherein the contour of said opening in said locking lever possesses a first opening ramp, intended to drive said cam finger in the direction for opening said door when said locking lever pivots in said second direction.

5. An automobile door locking device according to claim 4, wherein the contour of said opening in said locking lever possesses a second unlocking ramp, essentially opposite the first, intended to be actuated by said cam finger driven by the second door locking bolt at the instant the door slams shut, so that said locking lever is caused to pivot in said second direction corresponding to the unlocking of the door and to release the engagement of the lug of said second control lever with said elongate slot of said locking lever opening.

6. An automobile door locking device according to claim 2, wherein said locking lever has an extension the end of which enters a notch in said first control lever disposed at right-angles to the said extension, so that the locking lever can be moved in one direction or the other.

7. An automobile door locking device according to claim 6, wherein said locking lever has a right-angle tab with a hole therein, the tab being essentially opposite said extension and the upper and lower edges of said hole serving as contact points for said locking bolt to respectively lock and unlock the door, from the outside.

8. An automobile door locking device according to claim 2, wherein said second control lever tends to return to its rest position under the action of a return spring.

9. A door locking device for an automobile which comprises:

a support on the automobile door;

a locking lever pivotably mounted on said support, being movable in a first direction for locking said door and movable in a second direction, opposite the first, for unlocking and opening said door;

a first control lever attached to said automobile cooperable with said locking lever for moving said locking lever selectively in either said first direction or said second direction;

a locking bolt cooperable with said locking lever for moving said locking lever selectively in either said first direction or said second direction; and means for moving said locking lever in said second direction responsive to the closing of said door wherein said locking lever has an extension the end of which enters a notch in said first control lever disposed at right-angles to the said extension, so that the locking lever can be moved in one direction or the other.

10. An automobile door locking device according to claim 9, wherein said locking lever has a right-angle tab with a hole therein, the tab being essentially opposite said extension and the upper and lower edges of said hole serving as contact points for said locking bolt to respectively lock and unlock the door, from the outside.

* * * * *